299-13 SR
11/4/80 XR 4,231,617

United States Patent [19] [11] 4,231,617
Larson et al. [45] Nov. 4, 1980

[54] CONSOLIDATION OF IN-SITU RETORT

[75] Inventors: Olaf A. Larson, O'Hara Township, Allegheny County, Pa.; Charles W. Matthews, Lakewood, Colo.

[73] Assignee: Gulf Oil Corporation, Pittsburgh, Pa.

[21] Appl. No.: 969,328

[22] Filed: Dec. 14, 1978

Related U.S. Application Data

[63] Continuation-in-part of Ser. No. 816,389, Jul. 18, 1977, abandoned.

[51] Int. Cl.[3] ..... E21C 41/10
[52] U.S. Cl. ..... 299/2; 166/289; 166/290; 299/11; 299/13
[58] Field of Search ..... 299/2, 11, 13, 4; 166/289, 290, 285, 286; 61/35

[56] References Cited

U.S. PATENT DOCUMENTS

| | | | |
|---|---|---|---|
| 1,919,636 | 7/1933 | Karrick | 299/2 |
| 2,481,051 | 9/1949 | Urens | 299/2 |
| 3,001,776 | 9/1961 | Van Poollen | 299/2 |
| 3,391,737 | 7/1962 | Havens | 166/289 |
| 3,459,003 | 8/1969 | O'Neal | 61/35 |
| 3,588,175 | 6/1971 | Whiting | 299/11 |
| 3,661,423 | 5/1972 | Gavred | 299/2 |

*Primary Examiner*—William F. Pate, III

[57] ABSTRACT

Shale oil is recovered from an underground oil shale deposit by in-situ retorting of rubblized shale in a retort formed in the deposit. Oil shale in a volume in the range of ten to fifty percent of the volume of the retort is mined from the deposit and delivered to the surface to provide void space for the expansion of the shale that occurs on rubblization to form the in-situ retort. The oil shale delivered to the surface is retorted at the surface. After completion of the in-situ retorting, boreholes are drilled downwardly through the retorted shale and a pipe lowered through the borehole to a level near the bottom of the retort. Spent shale from the surface retorting operation is slurried and pumped into the lower end of the in-situ retort. Pumping is continued to squeeze the slurry into the fissures between blocks of spent shale. The slurry is delivered into successively higher levels of the retort and the pumping and squeezing operation repeated at each level. In a preferred operation, slurry discharged into the retort is allowed to set before discharging slurry into the retort at a higher level to avoid excessive hydrostatic pressures on the retort.

19 Claims, 2 Drawing Figures

CONSOLIDATION OF IN-SITU RETORT

This application is a continuation-in-part of our application Ser. No. 816,389, filed July 18, 1977, entitled "Consolidation of In-Situ Retort" now abandoned.

BACKGROUND OF THE INVENTION

1. Field of the Invention

This invention relates to the in-situ combustion of oil shale to produce shale oil, and more particularly to a method of disposing of spent oil shale and stabilizing in-situ retorts in oil shale formations.

2. Description of the Prior Art

The oil shale deposits in the western states of the United States extend over thousands of square miles and over large areas are more than 1000 feet in thickness. Oil shale contains kerogen, a solid carbonaceous material which on heating to a temperature above about 800° F. yields shale oil. The oil shale deposits may produce from about 15 to 80 gallons of shale oil per ton of shale.

One method of recovering the oil from oil shale is to treat the oil shale at high temperatures in retorts located at the ground surface. Few of the shale deposits are located near enough to the ground surface to permit strip mining; consequently, expensive underground mining methods are necessary for removing oil shale from the deposits and delivering it to the surface. U.S. Pat. No. 3,588,175 of Whiting describes a number of different mining techniques for the mining of oil shale to be retorted at the surface. The cost of underground mining operations and lifting to the surface for retorting the volume of oil shale that would be necessary to produce shale oil has been a major factor in delaying production of shale oil. Moreover, disposal of spent shale produced in surface retorting is a difficult problem. U.S. Pat. Nos. 3,588,175 of Whiting and 3,459,003 of O'Neal suggest filling the mined-out cavity formed in his mining operation with an aqueous slurry of spent shale from surface retorting. The slurry contains excess water which separates from the spent shale and is removed from the mined-out cavity either by pumping or draining. Whiting states that the compaction of the fill as the height of fill increases causes movement against the side and thereby reduces the load on the bulkheads at the bottom of the mined-out cavity. O'Neal increases the strength of the mass by manufacturing a cement from a portion of the surface-retorted shale and pumping a slurry of the cement into the cavity.

Because of the expense of underground mining of shale, it has been proposed that the shale be retorted in-situ. The low permeability of shale makes it necessary to rubblize a retort in the shale deposit before the flow of air and combustion products necessary for in-situ combustion can be maintained. Rubblization is accomplished by mining by conventional underground mining methods a relatively small amount, ordinarily in the range of 10 to 50 percent of the shale in the zone of the retort, to provide void space to accommodate the expansion of the shale that occurs on subsequent blasting to rubblize the shale to form passages through it. In the preferred in-situ retorting process, the rubblized shale is ignited at the upper end of the in-situ retort and air is passed downwardly through the shale to burn carbonaceous material in the shale. Hot combustion products from the combustion front in the shale pass downwardly through unretorted shale to heat that shale to a temperature at which the kerogen is converted to shale oil. The shale oil drains to the bottom of the retort and is delivered into suitable apparatus for pumping to the ground surface.

In-situ combustion processes for the recovery of oil from oil shale are described in U.S. Pat. No. 3,001,776 of Van Poollen; U.S. Pat. No. 3,661,423 of Garrett; U.S. Pat. No. 1,919,636 of Karrick and U.S. Pat. No. 2,481,051 of Uren. Van Poollen returns shale mined to provide the void space for rubblization to the top of the in-situ retort while combustion takes place in the retort. Karrick delivers the mined shale to an underground shaft in which it is retorted. Garrett retorts the mined shale at the surface, delivers the shale to a previously mined-out underground chamber for retorting in that chamber or builds an "underground retort" for retorting the mined shale.

One of the problems that confronts in-situ retorting of oil shale is the stability of the underground retort after the in-situ retorting operation has been completed. It has been reported that because of the loss of strength of the shale that occurs on retorting, the removal of kerogen from the shale in the in-situ retorting and the high compressive forces exerted by the shale in a retort that may be 700 feet or more high, shrinkage of 5 percent or more of the retorted rubblized shale may occur. The resulting void space at the top of the retort can cause subsidence of the overburden. Additionally, in most instances an in-situ retort will cross several water-bearing strata. It is necessary to seal the retort to prevent flow through the retort from one aquifer to another after the retorting has been completed.

SUMMARY OF THE INVENTION

This invention resides in a method of stabilizing an underground retort in an oil shale deposit after completion of in-situ retorting of rubblized shale in the retort. Part of the shale in the zone of the retort is mined and lifted to the surface to provide void space of 10 to about 50 percent of the volume of the retort for rubblization. Combustion of carbonaceous material in the rubblized shale supplies heat for in-situ retorting of that shale to produce shale oil. The mined oil shale is delivered to the surface and retorted. Spent shale from the surface retorting is slurried and squeezed into successively higher levels of the spent rubblized shale in the in-situ retort to fill the void space in that retort.

DESCRIPTION OF PREFERRED EMBODIMENT

Figures 1, 2:
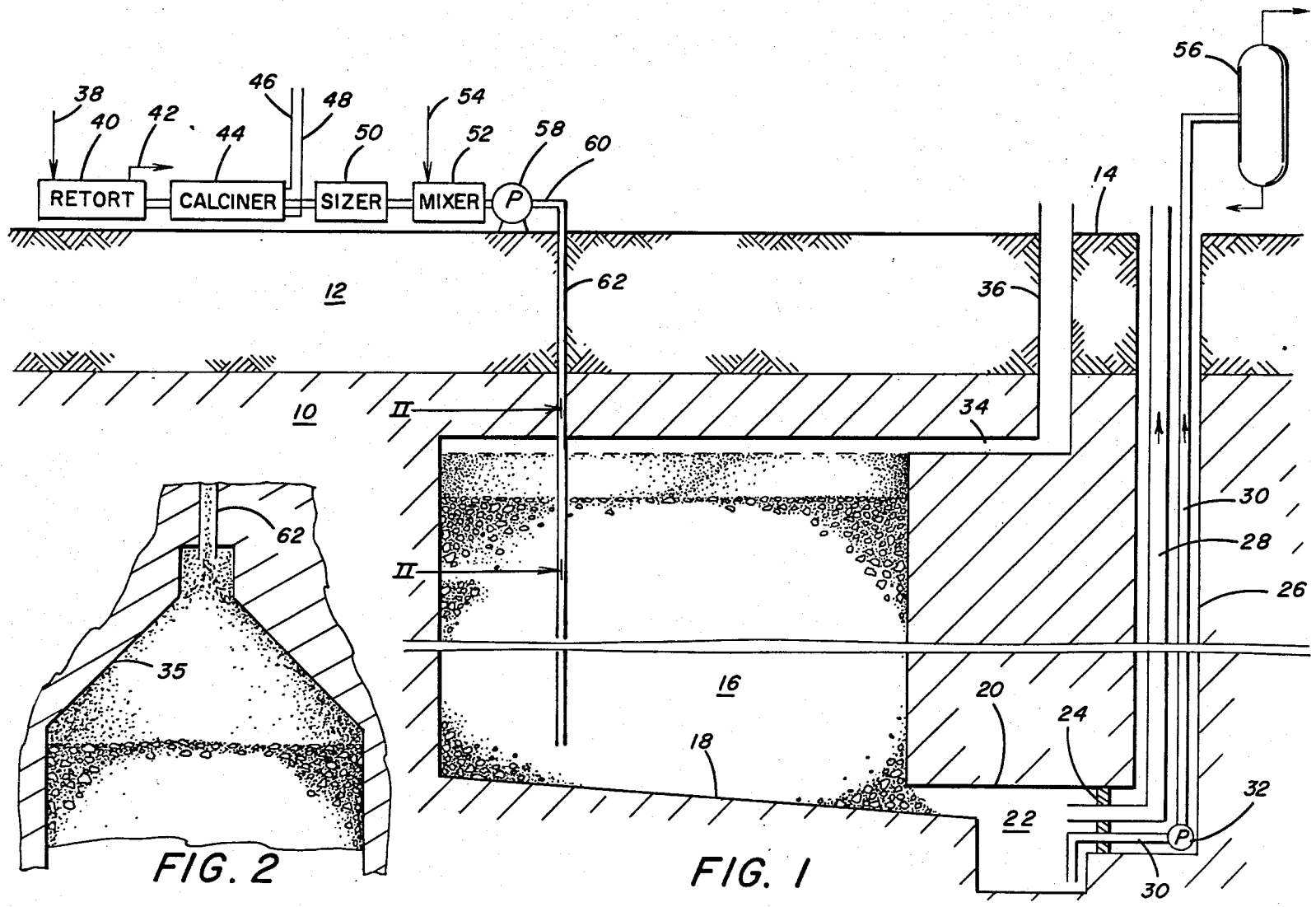
FIG. 1 is a diagrammatic vertical sectional view of an in-situ retort with associated surface equipment for this invention.
FIG. 2 is a diagrammatic sectional view along the section line II—II in FIG. 1 after stabilization of an in-situ retort by this invention.

Referring to FIG. 1, an underground shale deposit 10 is shown with overburden 12 between the shale deposit and the ground surface 14. Within the shale deposit 10 is a rubblized in-situ retort 16 which may be prepared by any of a number of procedures such as those described in Karrick U.S. Pat. No. 1,919,636; Uren U.S. Pat. No. 2,481,051; Van Poollen U.S. Pat. No. 3,001,776; Garrett U.S. Pat. No. 3,661,423; etc. The rubblized shale preferably has a void space of about 20 percent which is adequate to allow rubblization of the shale in the retort and to make it permeable but low enough to minimize the mining expense and to facilitate stabilization of the retort as hereinafter described. The void space may, however, range from 10 percent to about 50 percent. In the embodiment of the invention illustrated in the drawing, in-situ retort 16 has a bottom 18 sloping to a drift 20 which opens into a sump 22. Drift 20 is closed at the end of the sump 22 remote from retort 16 by a barricade 24. Drift 20 continues past barricade 24 to communicate with a vertical shaft 26 used during the formation of retort 16 for lifting mined shale to the surface. A gas conduit 28 extends through barricade 24 into the upper portion of drift 20 above the sump 22 and upwardly through shaft 26 for delivery to the surface of off-gases produced during in-situ combustion. A liquid line 30 from sump 22 extending through barricade 24 is connected with a pump 32 for delivery of liquids from the sump 22 to the surface.

A tunnel 34 extends longitudinally along the top of retort 16 for delivery of air during the in-situ combustion operation. Tunnel 34 communicates with an air shaft 36 through which air is delivered for the retorting procedure. The roof 35 of the retort slopes downwardly from the tunnel 34 to the sidewalls at an angle with the horizontal of at least 35° and preferably 40° to 50°, to increase the stability of the roof and minimize the danger of roof fall during rubblizing and retorting operations. In a typical in-situ retorting operation retort 16 may be 150 feet wide, 300 feet long, and 700 feet high.

In the operation of the in-situ combustion retort, rubblized shale in the upper portion of the retort 16 is heated to a temperature at which the shale will burn by delivering air through shaft 36 and tunnel 34 into the top of the retort 16 and burning a fuel supplied by suitable means, not shown in the drawings, extending from the ground surface into the retort. After ignition of the shale, injection of the fuel is stopped and air injection is continued to cause burning of the shale whereby the combustion front moves downwardly through the rubblized shale. Hot combustion gases from the combustion front flow downwardly through the shale ahead of the combustion front and heat the shale to a temperature at which the kerogen is converted to shale oil. Shale oil and combustion gases flow to the bottom of the retort 16 and through drift 20 into the sump 22. Oil and water produced in the retorting are separated from the off-gases in sump 22 and pumped by pump 32 through line 30 to the surface. Off-gases flow through conduit 28 to the surface for treatment in any desired manner.

In conducting this invention, the in-situ retorting of the oil shale in retort 16 is continued to the desired extent, which may be when the production of shale oil does not justify further compression of air for passing through the retort. In some instances, it may be desirable after production of shale oil has decreased to a rate at which the value of the oil does not justify continued air injection, to continue the injection into retort 16 of air alone or mixed with water or alternately with the injection of water to produce gas from the hot carbonaceous residue on the spent shale in the retort 16. After the gas production, if any, subsequent to retorting in in-situ retort 16 has been completed, spent shale from surface retorting is slurried and pumped into the retort, as hereinafter described.

Spent shale in the retort after retorting is complete is characterized by blocks of substantially the same configuration as before retorting separated by fissures which impart permeability to the gross shale mass within the retort. The blocks may be as large as approximately two feet cubed. Some compaction, for example 5 percent or more of the volume of the raw shale in the retort, may occur on retorting. The irregular interlocking shape of the lumps of the spent rubblized shale in the retort and the low void space resist further settling and result in a stable mass that provides lateral support for the walls of the retort. The spent shale remaining in the in-situ retort is highly hygroscopic and will take up a large amount of water either by hydration, absorption, or both.

The oil shale mined to provide the void space for the in-situ retort is delivered to the surface and subjected to retorting at the ground surface to recover shale oil from the kerogen present in that shale. The retorting may be accomplished by any of the several methods that have been proposed for the retorting of shale oil. In a typical retorting process such as is described in U.S. Pat. No. 3,130,132 of Sanders, shale crushed to approximately a one-half to two inch mesh is delivered into the upper end of a cylindrical retort and passed countercurrently to an upwardly flowing stream of air. Shale in the retort is ignited and the upwardly flowing hot combustion gases heat the descending shale to a temperature at which the kerogen is decomposed and the resultant shale oil is withdrawn from the retort. Spent shale is discharged from the bottom of the retort. Other processes can be used for retorting the mined shale that was delivered to the surface. In some processes, oil shale is caused to flow upwardly through the retort. In others, crushed shale is heated in a rotating kiln-type apparatus by contact with hot solid particles of materials such as metallic or ceramic spheres. In still another process that has been proposed for retorting oil shale, hot spent shale from a heater is mixed with ground raw shale in a retort-mixer whereby the raw shale is quickly heated to retorting temperature.

Located above the ground surface 14 is apparatus for recovering oil from the oil shale that is mined to provide the void space necessary for rubblization in the in-situ retort. The apparatus includes a retort for heating the shale to a temperature high enough to liberate oil from the kerogen in the shale and apparatus for sizing the spent shale that will allow it to be slurried in water for delivery into the in-situ retort. Since it is an object of this invention to stabilize the rubblized spent shale and seal the retort 16, it is desirable that the slurry of spent shale have cementitious properties. It may, therefore, be necessary to calcine the spent shale from the surface retorting for further removal of carbonaceous material to improve its cementing properties. In those processes for the surface retorting of oil shale in which the shale is ground to a small particle size in preparation for the surface retorting, further grinding subsequent to the retorting may not be necessary. In processes of the type in which a bed of broken shale particles is caused to move downwardly through a vertical cylindrical retort generally countercurrently to an ascending stream of air or hot combustion products and liberated gas, grinding and sizing will be necessary to produce a slurry in which the spent shale particles can be suspended and transported for a substantial distance in an aqueous slurry.

Referring to FIG. 1, shale from surface storage, not shown, is delivered by suitable conveyor means indicated by line 38 into a retort 40. The shale is heated in retort 40 to a temperature high enough to liberate the shale oil and gaseous products which are discharged from the retort through line 42. In the particular embodiment illustrated in the drawing, it is considered that the retorting employs a well-known process that has been proposed for commercial installations in which the shale in the retort is heated by contact with hot ceramic or metallic spheres. In that retorting process, calcination of the spent shale to reduce the carbon content and improve the cementing properties of the slurried spent shale is desirable.

Spent shale from the retort 40 is delivered into a calciner 44 in which the spent shale is heated by countercurrent contact with hot oxygen-containing flue gases to complete the calcination and burn carbon remaining on the spent shale discharged from the retort. Fuel is delivered into the calciner 44 through line 46 and air or other oxygen-containing gas is delivered into the calciner through line 48. It is contemplated that the calciner will be operated at a temperature of 1300° F. to 1600° F. or higher.

Calcined shale is delivered from the calciner 44 into sizing apparatus 50. Sizing apparatus 50 ordinarily includes grinding and screening means which will reduce the particle size of the spent shale to a maximum of about 20 mesh, and preferably a maximum of about 40 mesh, and still more desirably to the range of 40 to 100 mesh. The maximum size of the spent shale particles is such that the particles can be suspended in the aqueous medium of the slurry that is subsequently formed to transport the particles throughout the rubblized in-situ retort, as hereinafter described. Sizing apparatus 50 will usually include grinding and screening apparatus with recirculating means for recycling oversize particles from the screen through the grinding apparatus.

Spent shale particles are delivered from the sizer into a mixer 52 in which the shale particles are suspended in an aqueous medium to provide a slurry for pumping the particles. It is preferred that the slurry have a high concentration, for example 40 to 60 percent by weight, of solid particles, but because of the highly hygroscopic nature of the spent shale in the retort, more dilute slurries can be used. Water for the slurry is delivered into the mixer through line 54. In a preferred arrangement, liquids pumped from the sump through pump 32 are delivered through line 30 into a separator 56. Water removed from the bottom of the separator is delivered to mixer 52 for the preparation of the slurry. Such water may contain traces of contaminants that cause problems in disposal of the water. By using that water in this process, some of those contaminants can be trapped underground. The spent shale slurry from the mixer is pumped by pump 58 through a suitable header 60 into a vertical pipe 62 extending downwardly through the spent shale to near the bottom of the retort 16. To avoid damage to pipe 62 during the rubblization or by the heat that is liberated during retorting of the rubblized shale, the vertical borehole for pipe 62 is drilled after the retorting of the rubblized shale is completed. To simplify the drawing, only a single pipe 62 is shown. Actually, a plurality of such pipes, preferably positioned near enough to the walls to insure sealing the sides of the retort and to distribute the slurry across the retort, are used. Preferably, a suitable bulkhead is constructed in drift 20 between the lower end of the retort and sump 22 before delivery of the cement slurry into the retort.

The slurry of spent shale discharged from the lower end of line 62 travels through the fissures between blocks of spent shale in retort 16 to fill the void space in the lower end of the retort. As pumping of the cement slurry is continued, the pressure required to force the slurry into the rubblized spent shale increases. Pumping is continued to squeeze the slurry into the fissures between the blocks of spent shale until the pressure reaches a level that may approach the pressure required for fracturing the shale formation or breaking the wall of the retort. In the exploration of oil shale deposits, mining and rubblizing will proceed in some retorts while treating of spent retorts is proceeding. It is important, therefore, to avoid excessive pressures. The pipe 62 is then raised to a higher level in the retort and the delivery and squeezing of cement slurry into the spent shale of the retort is repeated. In a preferred embodiment, there is a delay after squeezing at each level to permit hardening of the squeezed shale before pumping the slurry into the retort at the next higher level. In this manner it is possible to avoid applying to the walls of the retort the extreme pressure that could be developed by a column of the slurry that might be the full height of the retort. Since retorts for in-situ retorting may have a height of 700 feet or more, it is apparent that such a column of slurry would develop very large forces on the wall of the retort. Ordinarily, a delay of a few hours to a day will be long enough to permit adequate hardening.

The procedure of squeezing spent shale slurry at successively higher levels is continued until the lower end of pipe 62 is located in tunnel 34 to fill the void space within retort 16 to a level at which the unsupported span of the ceiling 35 is self-supporting and, preferably, into the tunnel 34. If shaft 36 is to be used to supply air to other retorts, a bulkhead not shown in the drawings, should be erected in tunnel 34 between shaft 36 and retort 16 before delivery of the spent shale slurry and squeezing it at a level that would cause the slurry to flow into tunnel 34.

In some instances, the void space required for the rubblization will be obtained by mining at a plurality of levels and withdrawing the mined shale through extraction drifts at each of the sublevels. Those extraction drifts can then be used for access to the spent rubblized shale in the in-situ retort after retorting is completed. The slurry of spent retorted shale can be transported through pipes through those drifts and discharged into the rubblized shale. As in the embodiment using the vertical pipes, the slurry will be discharged into the retort from successively higher extraction drifts. Suitable bulkheads can be constructed in the drifts to permit the desired squeezing of the cement.

By delivering the spent shale slurry initially into the lower end of the retort 16 and squeezing the slurry, it is possible to fill the fissures between the lumps of spent shale in the retort with the cement slurry. The irregular shape, the large size, and the interlocking arrangement of the spent in-situ retorted shale all contribute to give a high stability to the mass in the retort as compared to a random filled retort. The cementitious properties of the spent shale slurry and of the spent shale rubble upon being wet with water form a consolidated mass which seals the side walls of the retort and provide strong lateral support to such walls. By coordinating the water content of the surface-retorted spent shale slurry, the volume of the shale mined to allow rubblization and the characteristics of the spent-in-situ retorted shale, the water in the slurry can be completely taken up by the in-situ retorted shale. The danger of applying excessive pressures to the walls of the retort can thereby be avoided without the necessity of providing wells or drains for removal of the water. Moreover, the cementitious properties of the in-situ shale are not impaired by cementing in an excessive volume of water.

The term squeezing is used herein to designate discharging the slurry of cement from the lower end of the pipe under a pressure high enough to force the slurry outward into the fissures between the lumps of shale in the retort. The pressure is adequate to force the slurry outward through the fissures between blocks of spent shale in the retort, break filter cakes of the slurry that may be formed, perhaps cause some shifting of the blocks, but not to fracture the walls of the retort.

The series of squeeze operations at successively higher levels in the retort fills the fissures from the bottom to the top of the retort to seal the retort and form a strong stable mass which supports the overburden above the retort. The strength of the consolidated mass in the retort is such that it can be used as a wall of an adjacent subsequently rubblized retort to thereby eliminate the necessity of massive pillars of unretorted oil shale between adjacent retorts. By permitting hardening of each layer of squeezed spent shale before squeezing the next higher layer, the walls of the retort and bulkheads constructed at lower levels are protected from excessive pressures. Since men may be working in adjacent underground mining operations, such protection is essential.

We claim:

1. A method of consolidating a rubblized in-situ oil shale retort, after in-situ retorting of the shale is completed comprising:

(a) retorting oil shale at the ground surface;

(b) preparing an aqueous slurry of spent shale from the surface retorting; and (c) pumping the slurry into the in-situ retort; wherein the pumping of step (c) is accomplished by discharging the slurry into the in-situ retort at successively higher levels in the retort and squeezing the slurry into fissures between blocks of in-situ retorted rubblized spent shale at each level to fill void space in the in-situ retorted shale, the squeezing of the slurry being accomplished at high pressures adapted to apply a pressure on walls of the retort below the fracturing pressure of the oil shale formation.

2. A method of consolidating a rubblized underground oil shale retort after in-situ retorting of the shale is completed comprising:

(a) retorting a quantity of oil shale at the ground surface;

(b) preparing a slurry of spent shale from the surface retorting;

(c) pumping the slurry down a pipe extending downwardly in the retort with its open end adjacent the bottom of the in-situ retort and discharging the slurry into the retort;

(d) squeezing the slurry into void spaces between blocks of rubblized spent shale in the retort, the squeezing of the slurry being accomplished at high pressures adapted to exert a pressure on the retort walls below the pressure required to fracture the shale formation;

(e) raising the lower end of the pipe to a higher level in the retort and discharging and squeezing the slurry into the retort at the higher level; and (f) repeating step (e) at successively higher levels in the retort to fill voids in the retort.

3. A method as set forth in claim 2 characterized by spent shale from the surface retorting being calcined at a temperature of 1300° to 1600° F. in the presence of air to remove carbon from the spent shale prior to incorporation of the spent shale in the slurry.

4. A method as set forth in claim 2 in which the spent shale from the surface retorting is crushed to a size smaller than 20 mesh prior to incorporation in the slurry.

5. A method as set forth in claim 4 in which the slurry contains 40 to 60 percent solids.

6. A method as set forth in claim 2 in which the spent shale from the surface retorting is calcined at a temperature in the range of 1300° F. to 1600° F. in the presence of air to remove carbon from the shale and the calcined spent shale is sized to a particle size smaller than 20 mesh prior to incorporation in the slurry.

7. A method of recovering oil from underground deposits of oil shale comprising:

(a) mining a quantity of shale in the zone of a desired underground retort ranging from 10 to 50 percent of the volume of the retort and lifting the mined shale to the surface;

(b) blasting the shale in the zone of the retort to form a permeable rubblized mass of shale in the retort;

(c) retorting the rubblized shale to liberate shale oil therefrom and lifting the produced shale oil to the surface;

(d) retorting the mined shale delivered to the surface at the surface;

(e) after retorting of the rubblized shale in the in-situ retort is completed, discharging a slurry of spent shale from the surface retorting from a pipe opening into the in-situ retort near the lower end thereof and squeezing the slurry at a pressure approaching the pressure required to fracture the shale formation to fill voids between blocks of rubblized spent shale in the retort; and (f) repeating the step of discharging the slurry of spent surface retorted shale at successively higher levels in the in-situ retort and squeezing the cement at each level to fill void space in the retort from the bottom of the retort substantially to the top.

8. A method as set forth in claim 7 in which the rubblized shale in the in-situ retort is retorted by:

(a) ignition of shale at the top of the retort;

(b) injecting an oxygen-containing gas into the top of the retort to cause a combustion front to proceed downwardly through the rubblized shale;

(c) delivering the shale oil from the retorting into a sump; and (d) lifting the shale oil from the sump to the ground surface.

9. A method as set forth in claim 8 in which the slurry of spent surface retorted shale is discharged into the retort at a plurality of locations at each level adjacent the walls of the retort to seal the walls of the retort.

10. A method as set forth in claim 8 characterized by:

(a) drilling holes from the ground surface downwardly through the spent rubblized shale in the in-situ retort after the retorting step;

(b) running pipe into the holes;

(c) pumping the slurry down the pipe;

(d) squeezing the slurry into the rubblized spent shale; and (e) raising the pipe and discharging and squeezing the slurry into the in-situ retort at successively higher levels to fill void spaces in the retort.

11. A method as set forth in claim 8 characterized by:

(a) delivering to the surface shale oil and water produced by retorting the rubblized shale;
(b) separating the water and oil; and
(c) mixing the separated water with spent surface retorted shale to form the slurry.

12. A method as set forth in claim 7 characterized by calcining the surface retorted shale at a temperature in the range of 1300° F. to 1600° F. in the presence of an oxygen containing gas, and then forming a slurry of the calcined spent shale for discharging into the in-situ retort.

13. A method as set forth in claim 1 characterized by delaying squeezing the slurry into the retort at one level until shale in the next lower level sets to protect the lower part of the retort from excessive pressures.

14. A method of consolidating a spent rubblized in-situ oil shale retort as set forth in claim 1 characterized by the amount of water delivered into the spent in-situ retort in the slurry of surface retorted shale being less than the maximum amount the shale in the retort can assimilate to reduce the pressure on the walls of the retort.

15. A method as set forth in claim 1 characterized by:
(a) drilling holes from the ground surface downwardly through the spent rubblized shale in the in-situ retort after the retorting step;
(b) running pipe into the holes;
(c) pumping the slurry down the pipe;
(d) squeezing the slurry into the rubblized spent shale; and
(e) raising the pipe and discharging and squeezing the slurry into the in-situ retort at successively higher levels to fill void spaces in the retort.

16. In a method of consolidating a spent in-situ retort for the recovery of shale oil from oil shale, the improvement comprising pumping an aqueous slurry of retorted oil shale downwardly through a pipe and discharging the slurry from the pipe at a high pressure adapted to apply a pressure on the walls of the retort below the fracturing pressure of the oil shale formation to squeeze the slurry into voids in the spent shale in the retort in a series of steps at successively higher levels in the retort to fill voids in the retort and cause setting of the in-situ retorted shale.

17. The method of claim 16 characterized by drilling a borehole through the spent shale after the in-situ retorting, and running the pipe for the aqueous slurry downwardly through the borehole.

18. A method as set forth in claim 1 characterized by mixing water produced from the in-situ retorting of the oil shale with spent surface-retorted shale in the preparation of the slurry.

19. A method as set forth in claim 16 characterized by allowing the slurry of spent shale squeezed into the retort at one level to set before squeezing slurry into the retort at a higher level to lower thereby the hydrostatic pressure applied to the bottom of the retort.

* * * * *